United States Patent [19]

Adler et al.

[11] 4,328,439

[45] May 4, 1982

[54] INDUCTIVE SIGNAL SOURCE FOR INTERNAL COMBUSTION ENGINE IGNITION SYSTEM

[75] Inventors: Karl-Heinz Adler, Leonberg; Adolf Fritz; Günter Brand, both of Stuttgart; Eugen Kielbas, Rosswas, all of Fed. Rep. of Germany

[73] Assignee: Robert Bosch GmbH, Stuttgart, Fed. Rep. of Germany

[21] Appl. No.: 140,785

[22] Filed: Apr. 16, 1980

[30] Foreign Application Priority Data

Apr. 28, 1979 [DE] Fed. Rep. of Germany ..... 2917404

[51] Int. Cl.[3] ..... F02P 1/00

[52] U.S. Cl. ..... 310/70 R; 123/617

[58] Field of Search ..... 310/70 R, 70 A; 123/617

[56] References Cited

U.S. PATENT DOCUMENTS

| | | | |
|---|---|---|---|
| 3,299,875 | 1/1967 | Skay | 310/70 R X |
| 4,166,966 | 9/1979 | Wittlinger | 310/70 R X |
| 4,176,645 | 12/1979 | Jundt et al. | 123/644 |

FOREIGN PATENT DOCUMENTS 2450752 5/1976 Fed. Rep. of Germany .

*Primary Examiner*—J. V. Truhe
*Assistant Examiner*—Morris Ginsburg
*Attorney, Agent, or Firm*—Frishauf, Holtz, Goodman & Woodward

[57] ABSTRACT

To provide an inherent delayed effect of spark trigger pulses derived from a magnetic transducer in which a salient pole piece of a rotor rotates with respect to a salient pole piece of a stator and, upon juxtaposition, a pulse is induced in a pickup coil magnetically coupled to the rotor-stator circuit, the rotor pole piece is formed to have an arcuate length greater than that of the stator pole piece, with stepped configuration so that, with respect to angle of rotation, the output voltage derived from the coil will have, after passing through zero or null, a half wave which has a portion (C) of decreasing rate of change of absolute value, or differential thereof, and a subsequent and adjacent portion (D) of increasing rate or differential of absolute value with respect to angular change with the sign of the differential remains the same, so that, on slow-speed operation, a trigger circuit set to respond only to the subsequent or adjacent portion will have a voltage induced therein only at a later time, that is, after the rotor has rotated to an angle beyond top dead center (TDC) position, upon high-speed operation, however, the curve portion immediately following the passage through zero or null already providing an output voltage sufficient to trigger the threshold circuit. The rotor can fit into all existing rotor structures, requiring only a modification of the shape of its salient pole piece.

7 Claims, 5 Drawing Figures

VOLTAGE - ROTATION DIAGRAM
U
0
-Us
α
Δα
α1
α'1
α2
α3
C
D
G
H
K
S
S'
LOW SPEED
PRESENT INVENTION
NORMAL OPERATING SPEED
PRIOR ART

φ
ADVANCE
RETARD
PRIOR ART
0
n1
n2
n
IGNITION TIMING
PRESENT INVENTION 14
4
A
B

4
F
14
E
13
11

INDUCTIVE SIGNAL SOURCE FOR INTERNAL COMBUSTION ENGINE IGNITION SYSTEM

The present invention relates to an inductive signal source or signal transducer for use with an external ignition internal combustion engine, for example of the automotive type.

BACKGROUND AND PRIOR ART

Various types of magnetic signal transducers have been proposed in which a magnetic circuit is established including a permanent magnet, an inductive coil, a stator and a rotor, the stator and rotor, each, having projecting teeth which, upon rotation of the rotor, change the magnetic reluctance path and thereby change the magnetic flux through the pick-up coil. As the projecting teeth leave mutually engaged positions, a sharp needle pulse is induced in the pick-up coil which is used to control generation of a spark in the spark plug of the engine system. Transducers of this type are described in the literature, see, for example, German Patent Disclosure Document DE-OS No. 24 50 752. Signal sources of this type should be so constructed that they are compatible with the structures of mechanical breaker systems for installation in existing distributor housings of well known and standard types. The signal sources are, thus, installed in a combined structure functioning both as an ignition signal source and as a distributor to distribute the spark energy to respective ones of various cylinders in a multi-cylinder engine. Additionally, the distributor-signal source unit includes means to adjust the ignition timing. The ignition timing apparatus usually is so designed that the ignition timing changes in dependence on speed of the internal combustion engine, and, additionally, may have a further adjustment which is coupled to the intake manifold or induction pipe of the engine to change the ignition timing in dependence on vacuum therein. The various ignition timing adjustment elements, of standard and well known construction, are effective only after the engine has reached a certain speed, above the minimum speed upon, or shortly after, starting. Thus, adjustment of ignition timing by using the well known vacuum diaphragm adjustment and, for example, centrifugal adjustment, does not permit adjusting of the ignition spark to delayed or retarded operation, as would be desirable upon starting and when the engine is running immediately thereafter. Adjusting the spark towards retardation substantially facilitates starting of the engine since the spark plug can then initiate ignition of the air-fuel mixture reliably only after the piston has already passed the upper or top dead center (TDC) position.

THE INVENTION

It is an object to so construct an inductive signal transducer or signal source that, upon very low speed operation, the ignition event triggering pulses are retarded while maintaining compatibility of the system with other and standard ignition sources.

Briefly, the pole pieces of a rotor and stator are relatively so shaped that the voltage induced in the pickup coil, with respect to angular displacement of the rotor, has a half wave which, after passing through null, has a portion of decreasing rate or differential of absolute value with respect to crankshaft angle; subsequent and adjacent to that portion is a further portion of increasing rate or differential with respect to angle value until the peak value of the induced voltage is reached the sign of the differential remaining the same.

Under low-speed conditions, therefore, the portion of the wave which has a decreased rate of change will have such a value that it falls below the trigger value of a threshold circuit connected to the system so that the threshold circuit will be triggered only when the wave eventually reaches the second, and higher, rate upon approach to the peak value. A retardation of the trigger pulse to trigger the spark is thus effected. As the engine rotates faster, however, the absolute value increases so that the trigger threshold level will be passed already at an earlier time and for example before the curve portion of decreased rate of change has been reached so that, under normal and higher speed conditions, the signal source will function like any signal source of the prior art which does not provide the retardation upon low-speed conditions.

The particular voltage-angular displacement curve with the portions of different rate of change can readily be obtained by so shaping the projecting teeth of the rotor and stator, respectively, that one of the teeth, for example the stator tooth, will fit over the teeth of the rotor first to a substantial extent, then decreasing somewhat, and finally terminating completely. Preferably, one of the teeth, for example the stator tooth, is substantially narrower than the rotor tooth, and extends over a lesser angle than the rotor tooth, permitting the changing relative matching or covering surface portions to occur as the rotor rotates. The rotor tooth, preferably, is constructed in stepped form, with respective steps thereof matching or fitting opposite the narrower stator tooth. Of course, a plurality of such teeth can be located around the circumference of the rotor to generate a plurality of signals for each revolution of the distributor-breaker shaft.

The transducer or signal source has the advantage that, upon very slow-speed operation of the engine, the ignition event is automatically shifted towards retardation so that, upon starting, the engine spark will be retarded. No change in the construction of the distributor-signal source combination or of the transducer itself is needed, so that standard components and standard construction elements and sizes can be maintained. The only change required is the shape of the projecting teeth of the rotor, which can be readily accomodated within the dimensions of existing structures.

DRAWINGS

Figure 1:
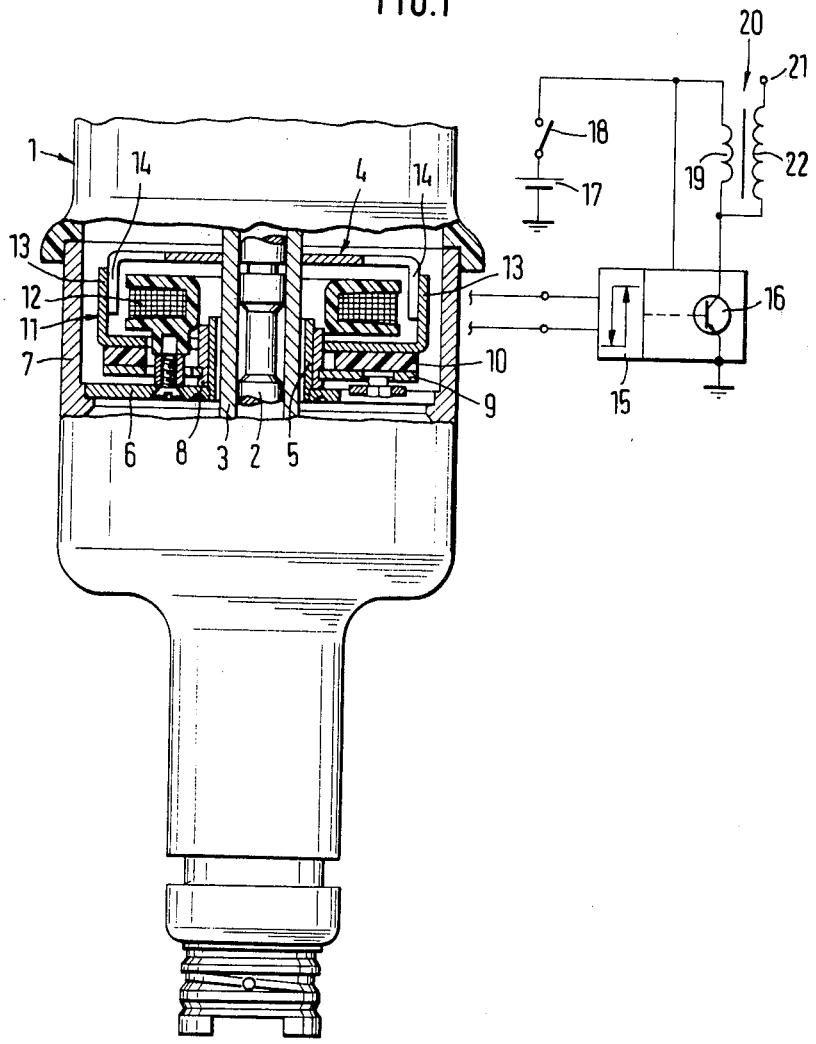
FIG. 1 is a schematic longitudinal cross-sectional view through a distributor-rotor unit, omitting all elements not necessary for an understanding of the present invention.

The signal source is located in an ignition distributor housing 1, having a shaft 2 coupled to rotate in synchronism with the crankshaft of the engine. The shaft 2 has a sleeve 3 located thereon. Sleeve 3 is of magnetically conductive material, for example iron, and rotates with the shaft but is adjustable with respect thereto by a speed-dependent, for example centrifugal ignition adjustment element of well known and suitable standard construction, in order to change the ignition timing with respect to speed. Sleeve 3 carries a rotor 4 of magnetically conductive material, for example iron, which is carried along with sleeve 3 and rotates therewith. The sleeve 3 is additionally surrounded by a guide bushing 5 of magnetically conductive material, which is fixedly secured in the central opening of a carrier plate 6. Carrier plate 6 is secured in the pot-shaped housing 7 by suitable means (not shown) and standard and well known. The guide bushing 5 is surrounded by a bearing bushing 8 made of magnetically conductive material, for example iron, which is secured in the center opening of a magnetically conductive adjustment plate 9 which, again, may be of iron. Adjustment plate 9 can be rotated with respect to the plate 6 of a limited angular extent under control of a load-dependent vacuum diaphragm, as well known, in order to provide for ignition adjustment as the load conditions on the engine change. The bearing sleeve 8 is concentrically surrounded by a ring magnet 10, which may be a ceramic or ferrite permanent magnet, having one facing side forming one pole and engaging the adjustment plate 9. The other side of the magnet 10 is connected to the stator 11 which, again, is made of magnetically conductive material, for example iron. Rotor 4 and stator 11 surround a toroidal pickup or transducer coil 12 which concentrically surrounds sleeve 3 and is secured to the carrier plate 6.

Figure 5:
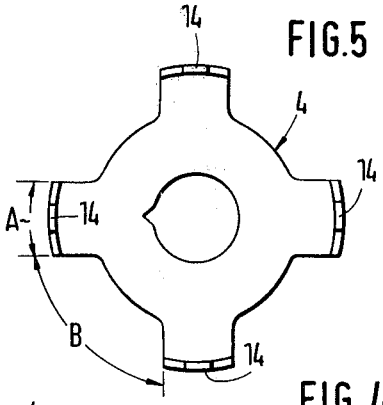
FIG. 5 is a top view of the rotor.

The magnetic flux derived from the permanent magnet 10, and passing through the elements 11, 4, 3, 5, 8, 9, and coupled to the pickup coil 12, changes as the rotor 4 rotates with respect to the stator 11. To effect change of magnetic flux, rotor 4 and stator 11 are each formed with a group of salient pole pieces. In the example illustrated, the pole pieces 13, and forming one group connected to the stator 11, are all identical; the second group of pole pieces 14, and secured to the rotor 4, likewise are all identical. As best seen in FIG. 5, the respective pole pieces 14 projecting from rotor 4 extend over a smaller arcuate portion A than the gaps B between the pole pieces 14. Similarly, the pole pieces 13 on stator 11 cover a much smaller arcuate extent than the gaps therebetween.

In accordance with the present invention, the respective shapes of the pole pieces 13 of the stator 11 and 14 on the rotor 4 are so shaped that the control signal curve in a voltage (U) - rotary angle ($\alpha$) diagram has a curve portion C, after the curve has passed through zero or null, which has a differential or rate of change of absolute value, with respect to angle of rotation, which is less than the preceding curve portion and also less than the subsequent curve portion D. The curve portion D again has a higher rate of change of absolute value with respect to angle of rotation until the peak value of voltage, S, is reached. As can be seen from FIG. 2, the sign of the differential remains the same, i.e. there is no reversal of the direction of the shape of the curve.

Figure 4:
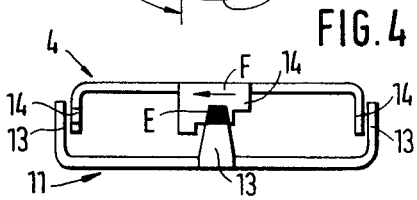
FIG. 4 is a schematic side view of the stator and rotor rotating with respect thereto.

The pole pieces 13 of the stator 11 are cylindrical wall portions, concentric with respect to the shaft 2, and matching over, that is, having projecting areas or zones with respect to the pole pieces 14 of the rotor 4. During rotation of the rotor, the outer circumference of the pole pieces 14 of the rotor 4 are adjacent the inner circumference of the pole pieces 13 of the stator 11, as the rotor rotates, for a limited period of time. During this transient adjacent position, each projecting portion 13 of the stator 11 is matched with each projecting portion 14 of the rotor 4 at least in part. One such matching or congruent surface area is illustrated at E in FIG. 4. Upon transient congruent position of the pole pieces 13 of the stator 11 and the pole pieces 14 of the rotor 4, the matching or congruent surface E first increases and then decreases, the relationship, with respect to angle of rotation, being such that the increase of the surface area E extends over a smaller angle of rotation than the decrease of the congruent surface portion E—see FIG. 4, in which the arrow indicates the direction of rotation of the rotor 14.

The pole pieces 14 of one group, for example the pole pieces 14 of rotor 4, extend over the arcuate portion A which is selected to be about twice as wide as the arcuate portion over which the pole pieces of the other group, in the present case the pole pieces 13 of the stator 11, will extend. The group of pole pieces which extend over the smaller arcuate angle, in the present case pole pieces 13 of the stator 11, are preferably slightly tapered towards the rotor, as clearly seen in FIG. 4, although the pole pieces 13 could also be essentially rectangular. The group of pole pieces which extend over the wider angle, that is, pole pieces 14 or rotor 4 in the present instance, has, in the direction of rotation indicated by arrow F, an increasing height. Preferably, this increasing height is in stepped form, although the exact shape is not critical. In a preferred form, it should at least closely approximate the stepped form of FIG. 4.

The control voltage period of the negative half wave is selected to form the control signal, for example by connecting a diode in the output of the coil 12. When the control signal has reached a voltage value $-$Us (FIG. 2), a threshold switch 15 set for the voltage $-$Us and connected to coil 12 will be triggered to control an evaluation circuit which, in turn, controls the emitter-collector path of a switching transistor 16 to blocked condition. Consequently, current supplied from a source 17 through an ignition switch 18 and the primary 19 of an ignition coil 20 is suddenly interrupted, resulting in a high-voltage pulse at the high-voltage terminal 21 of the secondary 22 of ignition coil 20. The high-voltage pulse 21 then can be connected to a spark plug, over a suitable distributor if the engine is of the multi-cylinder type. The threshold switch 15 may, for example, be a well known Schmitt-trigger circuit.

Figure 2:
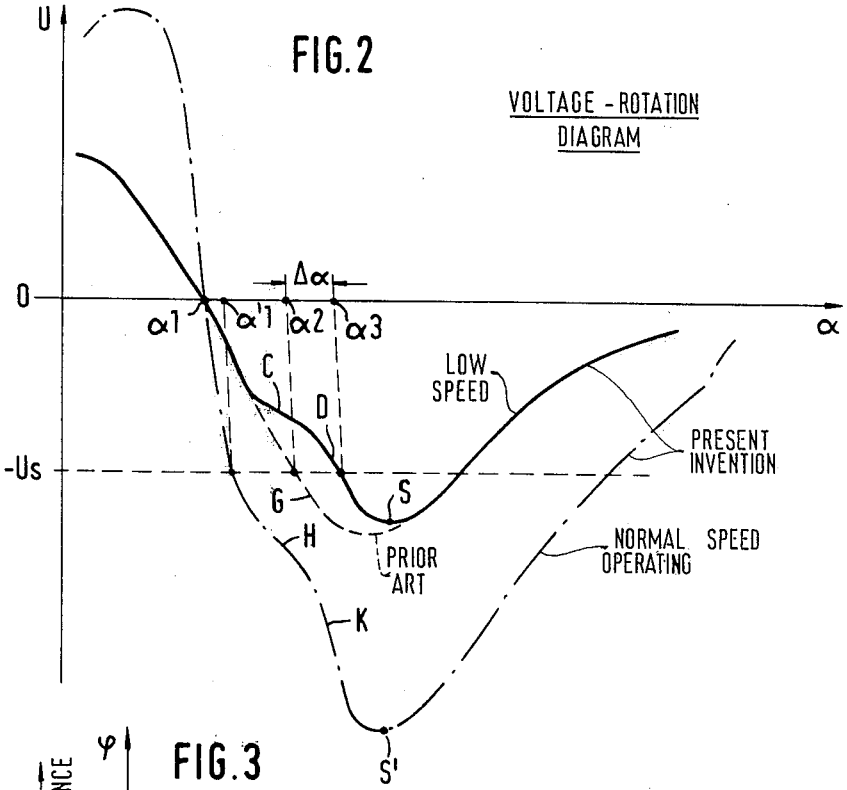
FIG. 2 is a voltage (ordinate) vs. rotary angle ($\alpha$) diagram.
Figure 3:
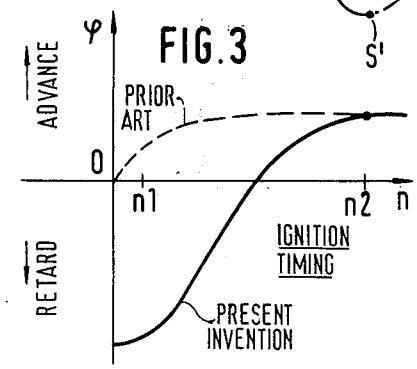
FIG. 3 is a diagram of ignition advance/retard angle $\phi$ (ordinate) with respect to engine speed.

Operation, with reference to FIGS. 2 and 3: Upon starting of the engine, and when shaft 2 rotates only slowly, a control signal will be derived from the output of the signal source which has a wave shape—with respect to angle of rotation of shaft 2—as shown in the full line of FIG. 2. After passing through zero or null, the signal will have a steep slope, followed by a portion C of substantially lesser slope, with subsequent transition to a portion D of steep slope until the peak value S is reached. The portion of the curve C-D up to about S departs from the curve G shown in broken line. The curve G in broken line illustrates the voltage relationship which arises in known transducers, for example of a type known in the prior art. Both the signal derived from the apparatus of the present invention as well as of the prior art will pass through zero or null at the same angular position $\alpha 1$. After having passed through zero or null, the curves of structures of the prior art and of the present invention are congruent until the stepped position of the rotor 14 comes into congruence with the pole piece 13, resulting in the deviation, namely the curve portion C. In the transducer of the present invention, the rise in instantaneous value of the output signal will be delayed. Consequently, the threshold voltage $-$Us of the threshold switch 15 will be reached only at the angle $\alpha 3$ of the rotor which, with respect to the angle $\alpha 2$ of the prior art transducers results in a delay of the spark or a shift by the value $\Delta\alpha$ in the direction of spark retardation. The retardation angle can be so selected, by suitable shaping of the pole pieces 13, 14 that, with respect to the crankshaft, the delay is between about 5° to 15° after TDC position; a preferred delay is about 10° retardation.

As the engine speed increases, the output will increase and the curve of voltage with respect to angle will shift towards the curve shown in chain-dotted line. The passage through zero or null at angular position $\alpha 1$ will be maintained. The threshold value $-$Us will occur at an earlier time, that is, at the angle $\alpha'1$ of the rotor 4, which is very close to the null position of the angle $\alpha 1$. At this speed also, and after the curve has passed through zero or null, a curve portion H will result in which the change of absolute value with respect to angle of rotation is less, so that the differential will have a lesser value, with subsequent transition to curve portion K of steeper slope until the peak value S' is reached. The portion of the chain-dotted curve below the threshold level $-$Us is not relevant with respect to triggering of the ignition event, however, since the threshold circuit 15 has already responded during the time of the curve portion in advance of the portion H of lesser slope, that is, during the time at which the chain-dotted curve would be congruent with a curve derived from a prior art transducer or pulse source.

As can be seen, the ignition timing is shifted towards retardation only when the engine runs very slowly; as the engine speed increases—and neglecting any changes introduced by a centrifugal adjustment device—the ignition timing will be shifted closer to TDC position, essentially to be the same timing as that of prior art pulse sources. This relationship is best seen in FIG. 3, where the ignition adjustment angle $\phi$ is plotted with respect to engine speed n. The broken-line position illustrates ignition adjustment of a prior art transducer; the solid line illustrates ignition timing adjustment in accordance with the transducer or signal source of the present invention. As can be clearly seen, at a low speed n1, corresponding, for example, to starting speed, timing adjustment is clearly retarded; at a higher speed, which can be determined by the shape of the pole pieces 13, 14, respectively, the curves merge with each other. Thus, starting from speed n2, modification of the shape of the pole pieces 13, 14, respectively, no longer has any influence on ignition timing. Thus, any adjustments of ignition timing made in existing distributor-signal source combinations with respect to normal operating speeds of the engine, will be maintained even if the rotor or the rotor-stator assembly is replaced by the combination specifically shown in FIGS. 4 and 5.

Various changes and modifications may be made within the scope of the inventive concept.

We claim:

1. An inductive signal source in combination with an external ignition internal combustion engine to provide ignition trigger signals to the engine having a stator (11);

a rotor (4);

an inductive coil (12) magnetically coupled to the stator and the rotor;

salient stator pole pieces (13) secured to the stator;

salient rotor pole pieces (14) secured to the rotor, said pole pieces being positioned relative to each other such that, upon rotation of the rotor, the rotor pole pieces pass adjacent the stator pole pieces at selected angular positions of the rotor and are positioned apart at other angular positions of the rotor to thereby change the magnetic flux passing through the inductive coil, and induce a voltage therein, and wherein the pole pieces are relatively shaped to induce a voltage in the coil (12) which, with respect to angular displacement of the rotor, has a half wave comprising after passing through null, a portion (C) whose absolute value changes at a decreasing rate or differential, with respect to change in angular position, and further comprising a subsequent and adjacent portion (D) of increasing rate or differential, in absolute value with respect to angle of rotation until the peak value (S) of induced voltage is obtained; and wherein the direction of the half wave between null and the peak value remains unvarying so that the sign of the differential between null and the peak value is unvarying.

2. Signal source according to claim 1, wherein the salient pole pieces (13, 14) of the stator (11) and of the rotor (4), respectively, are formed as cylindrical portions or elements which, at said selected angular positions, are at least partially congruent and form congruent surfaces;

and wherein the congruent surface areas (E), upon rotation of the rotor, first increase and then decrease and abruptly terminate;

and wherein the increase in congruent surface area (E) extends over a lesser angular extent than the region of decrease of congruent surface area, as the angle of rotation of the rotor pole piece, with respect to the stator pole piece, changes.

3. Signal source according to claim 2, wherein one of the salient pole pieces (14) extends over a wider arcuate extent than the other (13) of the salient pole pieces;

and wherein the salient pole pieces having the wider arcuate extent are formed as projecting portions of decreasing projecting extent.

4. Signal source according to claim 3, wherein the salient pole pieces having the wider arcuate extent have, which in developed form, an essentially stepped shape.

5. Signal source according to claim 4, wherein the pole piece of lesser arcuate extent is a cylindrical surface portion which, in developed form, has generally trapeze-shaped form with converging sides.

6. Signal source according to claim 3, wherein the pole piece of lesser arcuate extent is a cylindrical surface portion which, in developed form, has generally trapeze-shaped form with converging sides.

7. Signal source according to claim 1 or claim 2 or claim 3, in combination with a threshold switch (15) having a response threshold level responding to the voltage from said coil (12), upon operation of the engine under essentially starting condition, and immediately post-starting conditions, which is within the absolute value of the subsequent and adjacent curve portion (D).

* * * * *